US006261134B1

(12) United States Patent
Muzslay

(10) Patent No.: US 6,261,134 B1
(45) Date of Patent: Jul. 17, 2001

(54) ONE-PIECE HOODED SOCKET CONTACT AND METHOD OF PRODUCING SAME

(75) Inventor: Steven Zoltan Muzslay, Huntington Beach, CA (US)

(73) Assignee: ITT Manufacturing Enterprises, Inc., Wilmington, DE (US)

( * ) Notice: Subject to any disclaimer, the term of this patent is extended or adjusted under 35 U.S.C. 154(b) by 763 days.

(21) Appl. No.: 08/546,179

(22) Filed: Oct. 20, 1995

(51) Int. Cl.[7] ..... H01R 4/48
(52) U.S. Cl. ..... 439/852; 439/856; 29/857
(58) Field of Search ..... 439/842, 843, 439/851–857, 861, 862, 885, 886; 29/857, 884; 72/379.2

(56) References Cited

U.S. PATENT DOCUMENTS

| | | | |
|---|---|---|---|
| 3,083,351 | | 3/1963 | Nielsen . |
| 3,519,799 | | 7/1970 | Bange . |
| 3,538,491 | | 11/1970 | Longenecker . |
| 3,564,487 | | 2/1971 | Upstone . |
| 3,853,389 | | 12/1974 | Occhipinti . |
| 3,973,919 | | 8/1976 | Simon . |
| 4,139,256 | | 2/1979 | Seidler . |
| 4,152,042 | | 5/1979 | Ostapovitch . |
| 4,466,684 | | 8/1984 | Grant . |
| 4,834,681 | | 5/1989 | Chaillot . |
| 4,934,967 | | 6/1990 | Marks . |
| 5,119,664 | * | 6/1992 | Schubert ..... 72/379.2 |
| 5,167,543 | * | 12/1992 | Wurster ..... 439/885 |
| 5,186,663 | | 2/1993 | Wymelenberg . |
| 5,188,545 | | 2/1993 | Hass . |
| 5,230,632 | | 7/1993 | Baumberger ..... 439/66 |
| 5,281,175 | | 1/1994 | Chupak . |
| 5,288,252 | | 2/1994 | Steinhardt . |
| 5,350,321 | | 9/1994 | Takenouchi . |

FOREIGN PATENT DOCUMENTS

| | | |
|---|---|---|
| 2610456 | 8/1988 | (EP) . |
| 2613141 | 9/1988 | (EP) . |
| 0552741 | 7/1993 | (EP) . |

* cited by examiner

*Primary Examiner*—Tho D. Ta
(74) *Attorney, Agent, or Firm*—Roger C. Turner

(57) ABSTRACT

A one-piece hooded socket contact is disclosed which is formed from a sheet metal blank having alternately spaced fingers and tabs extending from a forward edge of the blank. The tabs are substantially shorter than the fingers. The tabs and fingers are bent rearwardly and the blank is formed into a cylinder forming the hood of the contact. The fingers extend inwardly toward the center axis of the hood to form the spring beams of the contact. The reversely bent tabs, together with the front ends of the fingers, form a lead-in chamfer at the front of the hood.

8 Claims, 4 Drawing Sheets

ONE-PIECE HOODED SOCKET CONTACT AND METHOD OF PRODUCING SAME

BACKGROUND OF THE INVENTION

The present invention relates generally to a socket contact for an electrical connector and, more particularly, to a one-piece hooded socket contact.

Conventional hooded socket contacts for electrical connectors are formed of two pieces, namely, a hood and a contact body. The hood is usually formed of stainless steel and the body is formed of copper, or a copper alloy. The hood is pressed onto the body by complex machines. Such a contact is relatively expensive to produce.

In order to reduce the cost of a hooded socket contact, it is desirable to eliminate the separate hood, and form the contact out of one piece of metal. Such a one-piece hooded socket contact is disclosed in U.S. Pat. No. 4,139,256 to Seidler. Seidler teaches the forming of the spring fingers of the contact by making U-shaped cuts in the sheet metal blank from which the contact is formed, behind the forward edge of the blank. This results in a substantial amount of sheet metal material being disposed between the fingers, as well as in front of the fingers. When the forward region of the sheet metal blank is folded rearwardly and rolled to form the cylindrical hood of the contact, it is difficult to roll the metal and maintain the shape of the fingers and forward end of the hood due to the double wall construction of the contact resulting from the sheet metal material lying between and in front of the fingers. This problem is particularly acute for small size contacts, such as a size 16 (1.5 mm) contact or smaller.

It is the object of the present invention to provide a one-piece hooded socket contact designed in such a manner that the front end of the hood and the spring fingers of the contact will have the desired configuration even for small size contacts.

SUMMARY OF THE INVENTION

According to a principal aspect of the present invention, there is provided a one-piece socket contact that is formed from a sheet metal blank that is stamped to provide at its forward end a plurality of spring fingers and relatively short lead-in tabs that extend forwardly from the front edge of the blank. The fingers and tabs are bent rearwardly and then the blank is rolled into cylindrical form to form the hood of the contact. The fingers extend inwardly toward the center axis of the hood to form the contact beams for engaging a mating pin contact, and the short lead-in tabs, together with the forward portions of the fingers, provide a lead-in chamfer for the pin contact ensuring that the pin contact will mate properly with the socket contact even if the pin contact is not properly aligned with the center axis of the socket contact. Because of the manner in which the fingers and tabs are initially formed in the sheet metal blank, it is easier to roll the sheet metal to form the hood, and maintain the circular shape of the front end of the hood and the lead-in chamfer, and of the spring fingers of the contact than in the prior art double wall, one-piece hooded socket contact described hereinabove. The method of the invention allows the manufacture of relatively small one-piece hooded socket contacts, for example, size 16 (1.5 mm) or size 20 (1 mm) contacts, without any appreciable distortion occurring during the forming and rolling process of the front-end portion of the socket contact where the configuration of the contact is critical for proper operation.

According to another aspect of the present invention, the one-piece hooded socket contact of the present invention is constructed from a sheet metal blank having the front region from which the hood and spring fingers are formed made of a spring-tempered metal, and the rear region of the blank that forms the crimp barrel of the contact made of a relatively more malleable metal. As a consequence, it is easier to form and roll the front region of the blank to form the spring fingers and lead-in tabs, the fingers will have high resiliency, and the crimp barrel is formed of the more malleable material which facilitates crimping of the barrel to a wire. The front region of the sheet metal blank may be made spring-tempered by either coining the metal blank to a reduced thickness, which work-hardens the metal to cause it to become spring-tempered, or to utilize a separate piece of spring-tempered metal which is bonded to the rear malleable region of the blank. The use of a sheet metal blank having the characteristics described herein greatly enhances the ability of the manufacturer to form the one-piece hooded socket contact of the present invention in small sizes.

DESCRIPTION OF THE PREFERRED EMBODIMENTS

Figure 1:
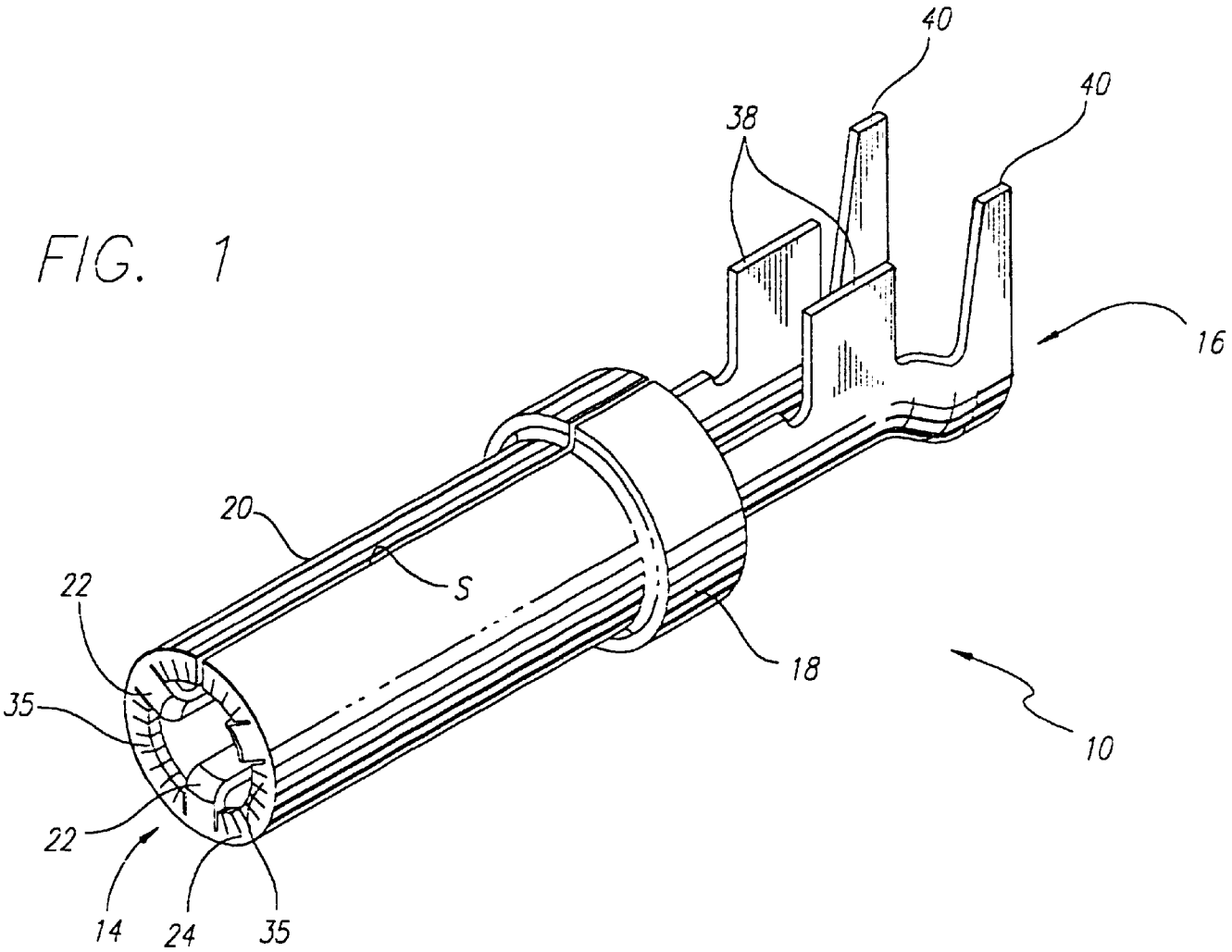
FIG. 1 is an isometric view of one embodiment of the one-piece hooded socket contact of the present invention.
Figure 2:
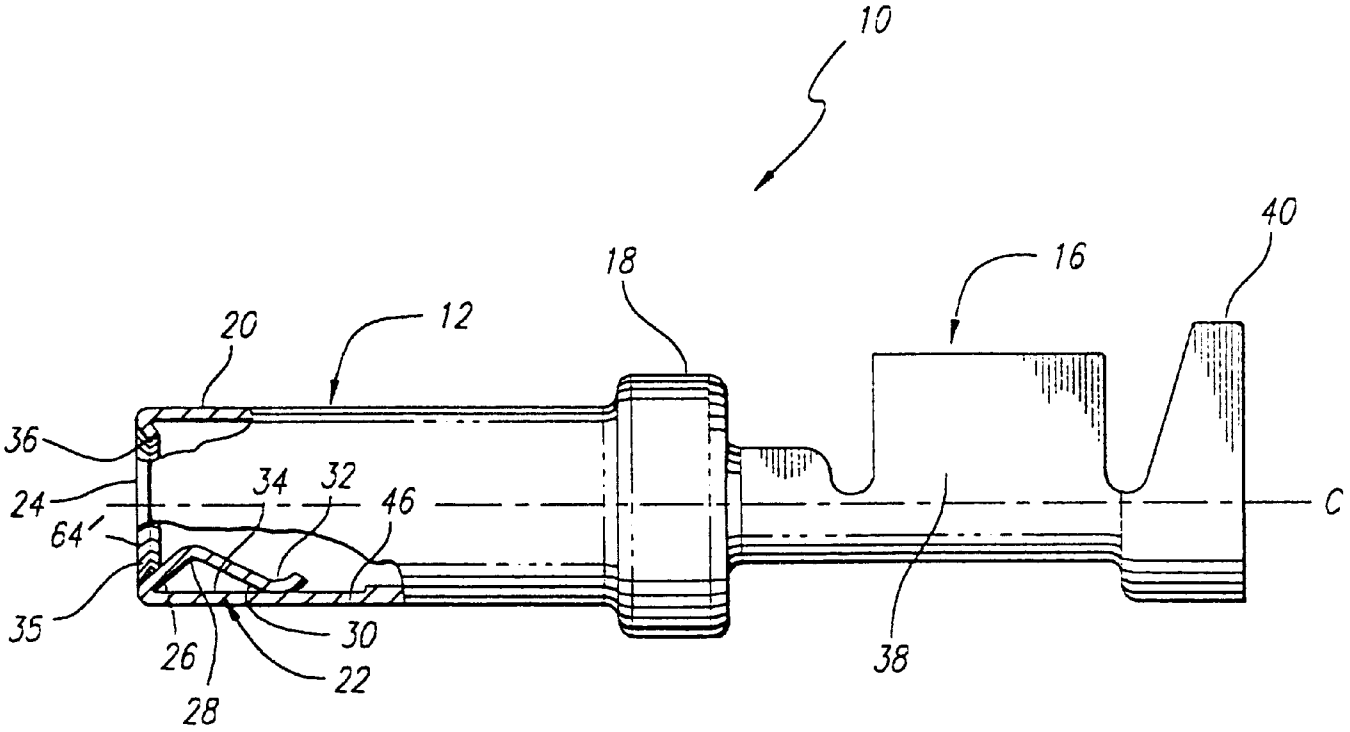
FIG. 2 is a side view of the socket contact illustrated in FIG. 1, with the front end of the hood of the contact shown in partial longitudinal section.
Figure 3:
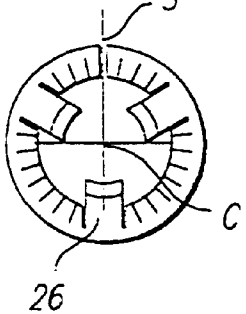
FIG. 3 is in an enlarged front-end view of the forward mating section of the contact shown in FIG. 2.

Referring now to the drawings in detail, there is illustrated in FIGS. 1–3 one embodiment of the socket contact of the present invention, generally designated 10. The contact comprises a one-piece sheet metal contact body 12 having a forward mating section 14 and a rear wire connection section 16, which is preferably in the form of a crimp barrel. An enlarged collar 18 separates the forward and rear sections of the contact body.

The forward mating section 14 of the contact includes a cylindrical hood 20. A plurality of spring fingers or beams 22 extend rearwardly from the front end 24 of the hood. Each finger comprises a forward portion 26 (FIG. 2) that extends rearwardly (R) and radially inwardly (i.e. toward the axis C) from the front end 24 of the hood toward the center axis C of the hood, and a curved contacting portion 28 that engages the mating pin contact (not shown) that is inserted into the front of the hood. Each finger also has a rear portion 30 that extends rearwardly and radially outwardly. The rear portion 30 of the finger terminates in an arcuate, reversely bent end 32 that engages the inner surface 34 of the hood. The reversely bent end 32 has a radially outward surface 110 that is convex. Alternatively, the end 32 may be spaced inwardly slightly from the inner surface of the hood, but only a distance such that when the mating pin contact is inserted into the socket contact, the end 32 will engage the hood.

In the embodiment of the invention shown in FIGS. 1–3, there is shown three spring fingers 22. For a size 16 contact, there would be typically three or four spring fingers. For a smaller contact, such as a size 20 contact, the contact would normally have only two spring fingers. The number of fingers is, of course, a matter of design choice, depending upon the size of the contact, it being understood that the greater number of fingers used enhances the reliability of the electrical engagement made between the mating pin and socket contacts.

Because of the configuration of the spring finger 22, the finger provides a double spring beam structure that increases the contact force between the mating pin and socket contact. Also, the engagement of the arcuate end 32 of each spring finger with the inner surface of the hood 20 during the mating of the pin and socket contacts results in a controlled engagement force between the two parts.

At the front of the hood 20 there are provided lead-in tabs 35 that are located between the spring fingers 22, and are spaced a short distance from the fingers. The tabs are substantially shorter than the fingers 22. Preferably the length of the tabs is less than one-quarter the length of the fingers, so that an open space exists between the fingers over at least three-quarters of the length of the fingers extending forwardly from the rear ends thereof. Such open spaces extend to the inner surface 34 of the hood. The tabs extend radially, inwardly toward the center axis C of the hood and rearwardly, at an angle complementary to the angle at which the forward portions 26 of the fingers extend into the hood so as to provide a generally cone-shaped entry for the mating pin contact. Such entry requires that the tabs form at least three radially innermost locations (at tab inner edges 36) shown at 102, 104 and 106 in FIG. 3, which are circumferentially spaced apart by an angle E of about 120° and lie on a circle centered on the axis C, to center a generally cylindrical pin contact within the hood. The front end 24 of the hood is smoothly curved to blend with the tapered tabs 35 and forward portions of the spring fingers.

Preferably, the radially inner rear edges 36 of the tabs 35 are coined to provide a smooth, curved surface so that when the pin contact is inserted into the socket contact of the invention, gold plating on the pin contact will not be scraped off the contact as would occur if the edges 36 were sharp.

The crimp barrel 16 of the contact 10 is of conventional form. It includes a pair of forward crimp tangs 38 and a pair of rear crimp tangs 40 that are crimped upon the wire and the jacket, respectively, of the electrical cable to which the contact is connected.

Figures 4, 5, 6, 7:
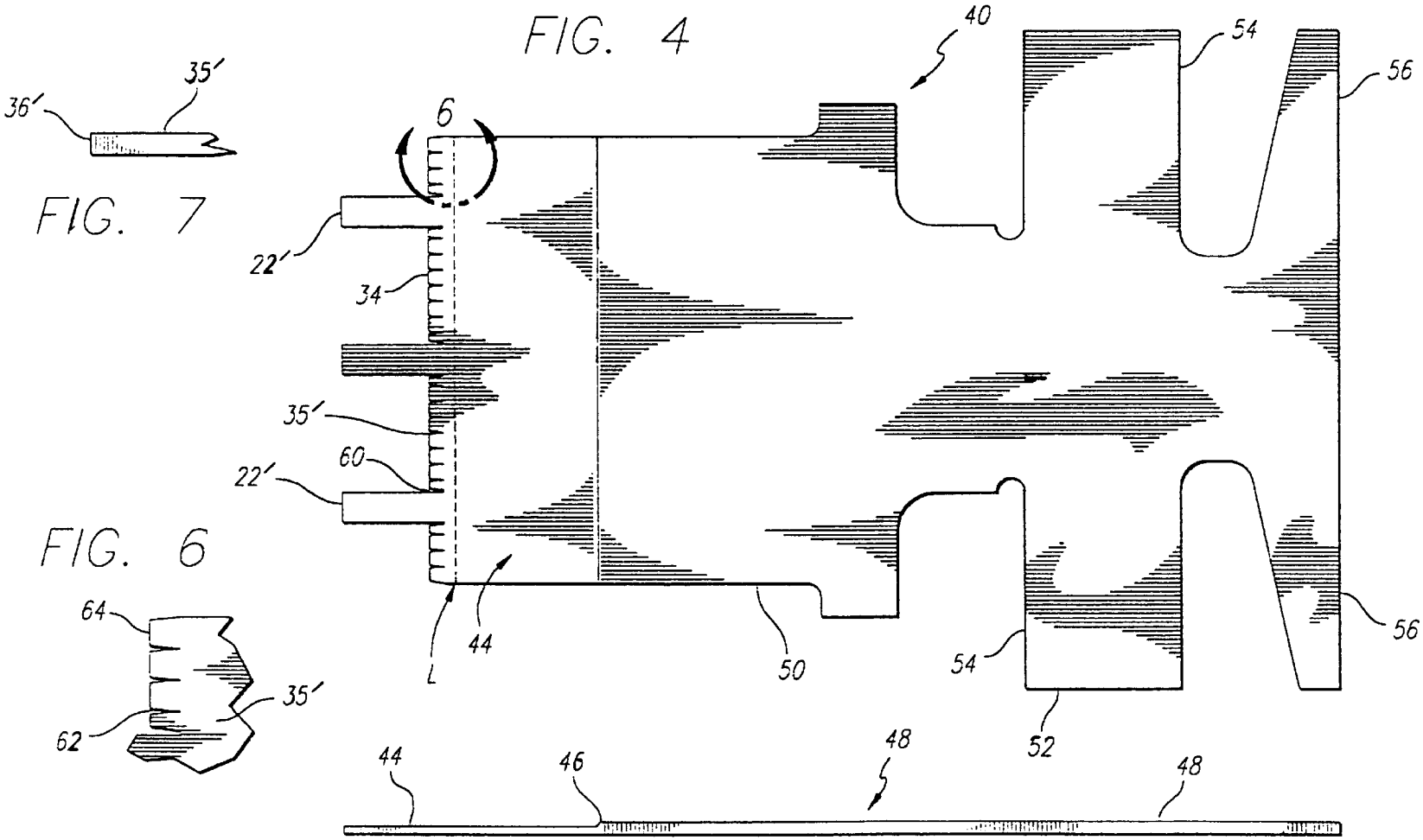
FIG. 4 is a plan view of the sheet metal blank from which the contact shown in FIGS. 1–3 is formed.
FIG. 5 is a side view of the sheet metal stock from which the blank shown in FIG. 4 is formed.
FIG. 6 is an enlarged view of the portion of FIG. 4 encircled by the line 6—6 illustrating more clearly a lead-in tab that is formed at the forward end of the sheet metal blank.
FIG. 7 is a side view of the tab shown in FIG. 6.

Reference is now made to FIG. 4 of the drawings, which shows the sheet metal blank 40 from which the one-piece hooded socket contact 10 of the invention is made. Preferably, the blank 40 is formed from sheet metal stock 42 as shown in FIG. 5 that has a forward region 44 in front of a dividing line 46, which has a thickness less than the thickness of the rear region 48 of the stock. In accordance with the present invention, the sheet stock is a generally malleable metal, such as quarter hard copper or beryllium copper alloy. The forward region 44 of the stock is coined down to a smaller thickness as shown in FIG. 5. The coining operation work-hardens the metal causing it to become spring-tempered, and hence more resilient than the rear region 48 of the stock. The rear region is malleable and, therefore, is suitable for crimping operations when formed into a crimp barrel. By way of example only, for a size 20 contact, a quarter hard copper alloy of 0.010 inch thickness may be coined down to a thickness of 0.006 inch at the forward region 44, so that the forward region is relatively resilient, and easier to form and roll. The sheet has a uniform chemical composition (a particular copper alloy) but comprises metals of different hardness and malleability.

Alternatively, the forward region 44 of the stock may be made of a separate spring-tempered metal sheet which is bonded to the rear region 48 of a more malleable metal sheet, such as by laser welding.

The sheet metal blank 40 shown in FIG. 4 is stamped from the sheet stock 42 shown in FIG. 5. The blank 40 includes a front part 50, that includes the dividing line 46 separating the tempered and malleable sections of the metal sheet, and a rear part 52. The front part has a generally rectangular configuration, while the rear part includes laterally-extending wings 54 and 56 which are bent up during the forming operation of the contact to provide the crimp tangs 38 and 40, respectively, of the finished contact, as best seen in FIGS. 1 and 2.

The stamped sheet metal blank 40 is formed with three fingers 22' that extend forwardly from the front edge 60 of the front part 50 of the blank. Tabs 35' located on opposite sides of the fingers 22' extend forwardly from the front edge 60, and are spaced a short distance from the fingers. As seen, the tabs are substantially shorter than the fingers 22'. The fingers 22' and tabs 35' of the blank 40 correspond to the spring fingers 22 and lead-in tabs 35 of the finished contact shown in FIGS. 1–3. Preferably, V-shaped slots 62 are formed at the forward edge 64 of the tabs 35', which facilitates the rolling of the tabs into an arcuate configuration when the front part 50 of the sheet metal blank is rolled to form the cylindrical hood 20 of the contact.

As seen in FIG. 7, the forward inner edge 36' of the tang 35' is coined to provide a smooth, curved surface that corresponds to the curved rear edge 36 of the tang 35 shown in FIG. 2.

To form the socket contact 10 of the invention, first the fingers 22' of the sheet metal blank 40 are formed to provide the curved contacting portion 28 and the rear portion 30 of the finished spring fingers 22 as seen in FIG. 2, and then the forward portion of the blank, including the fingers 22' and tabs 35', is bent upwardly at the bend line L so that the tabs and fingers extend rearwardly at an acute angle. As seen in FIG. 4, the bend line L is spaced a short distance behind the front edge 60 of the blank. Thereafter, the front part 50 of the blank is rolled upwardly into a cylindrical configuration to form the hood 20. During the rolling operation, the fingers 22' and tabs 35' become arcuately shaped and extend inwardly toward the center axis of the hood of the contact. Simultaneously with such rolling operation, or in a separate operation, the wings 54 and 56 at the rear part 52 of the blank are formed upwardly to provide the crimp barrel 16 of the contact. During the rolling operation of the front part 50 of the blank, the V-shaped slots 64 in the tangs will close to form slits 64' that extend to the rear edge of the tabs 35, as best seen in FIG. 3. The bend that is formed along the line L of the sheet metal blank provides a smooth, curved, continuous lead-in surface at the front of the hood of the contact.

Since the forward region of the sheet metal blank from which the contact 10 is formed is a spring-tempered metal of reduced thickness, it is relatively easy to form and roll the metal to produce the forward mating section of the contact, and the spring fingers 22 will have substantial resiliency for providing good electrical engagement with the mating pin contact. Furthermore, since the tabs 35 that form the lead-in chamfer for the hood of the contact are relatively short, the tabs will have an arcuate shape conforming to the circular configuration at the front end of the hood of the contact, even for small size contacts, such as size 20 and size 16.

Preferably the seam S of the rolled contact, shown in FIGS. 1 and 3, is welded or brazed to avoid opening of the seam when a pin contact is inserted into the socket contact 10.

Often it is desirable to provide a plating of highly conductive metal on the surface of the contacting portions of an electrical contact. Such a plating material might be gold or nickel. It is also desirable to selectively plate such regions of the contacts to avoid the waste, and the expense, that results in plating the entire contact, or substantial regions of the contact. In the present invention, since the spring fingers 22' of the blank 40 extend forwardly from the front part of the blank, the blank may be oriented in a vertical direction with the fingers extending downwardly, and the fingers may be passed through a plating bath up to a level just short of the ends of the tabs 35', with the result of the formation of the desired plating material on the contacting portions 28 of the fingers, and will avoid any wasted plating on any other part of the blank.

Figure 8:
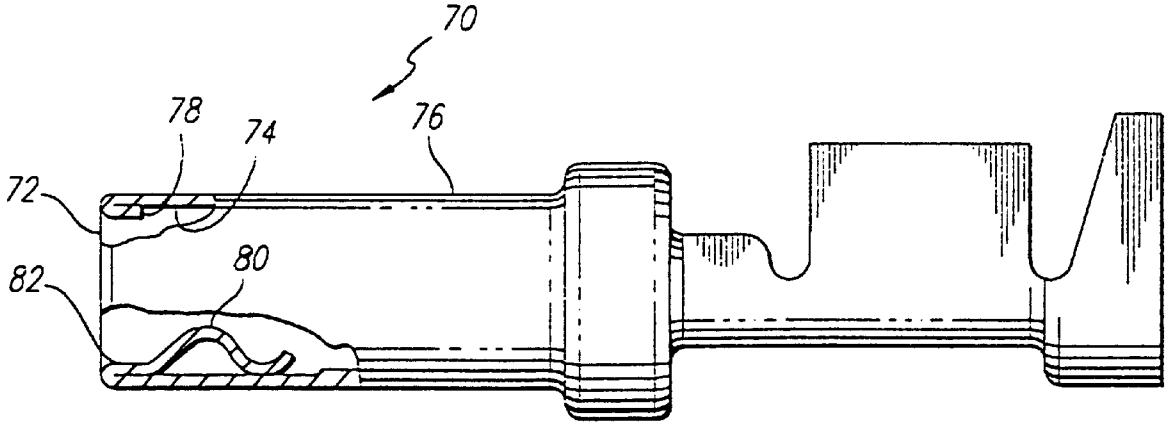
FIG. 8 is a partial longitudinal sectional view of the forward mating section of an alternative embodiment of the socket contact of the present invention.
Figure 9:
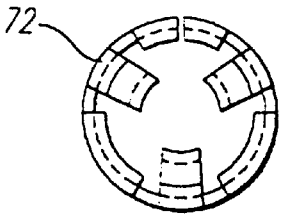
FIG. 9 is a front-end view of the forward mating section of the contact shown in FIG. 8.

FIGS. 8 and 9 show the front mating end of a second embodiment of the socket contact of the present invention, generally designated 70. The contact 70 is essentially the same as contact 10, except that the lead-in tabs 72 are bent 180° rearwardly so that their outer surfaces are flush with the inner surface 74 of the hood 76. As in the first embodiment of the invention, preferably the rear inner edge 78 of the tabs are coined to provide a curved surface. The spring fingers 80 are essentially the same as the fingers 22 of the contact 10, except that the forward portions 82 of the fingers are bent back 180° to lie flush against the inner surface of the hood 76 as do the tabs 72. If the contact 70 is a size 20, it may not be necessary to provide V-shaped slots in the tabs as shown in FIG. 6 in order to form the tabs to an arcuate shape without distortion.

From the foregoing, it is seen that by the present invention there is provided a method for producing a one-piece hooded socket contact which is particularly adaptable for contacts of small size, wherein multiple spring fingers may be employed having substantial resiliency to enhance the electrical engagement with the mating pin contact, and relatively short lead-in tabs are provided that can be formed into an arcuate configuration without distortion during the forming and rolling operations.

Although particular embodiments of the invention have been described and illustrated herein, it is recognized that modifications and variations to the invention may readily occur to those skilled in the art and, consequently, it is intended that the claims be interpreted to cover such modifications and equivalents.

What is claimed is:

1. A one-piece hooded socket contact formed from a sheet metal blank that is rolled to form the contact body comprising:

a contact body having a forward mating section and a rear wire connection section;

said mating section comprising a generally cylindrical hood having a front end and a reverse bend of more than 90° at said front end to form a plurality of spring fingers and lead-in tabs between said fingers, all lying within said hood and extending rearwardly from said hood front end with at least said fingers extending inwardly toward the center axis of said cylindrical hood; and said tabs having a length less than one-quarter that of said fingers, and being stiff to guide a pin contact with said tabs forming at least three radially innermost locations circumferentially spaced apart by about 120° about said axis and lying on an imaginary circle to center a pin contact of generally cylindrical shape in said hood.

2. A socket contact as set forth in claim 1 wherein:

each of said fingers has a forward portion extending rearwardly and radially inwardly, a curved contacting portion at the rear of said forward portion, and a rear portion extending rearwardly and radially outwardly toward the inner surface of said hood and terminating in an arcuate end;

said hood is cylindrical at locations radially outside said contacting portion to allow a large radially outward deflection of said contacting portion; and said arcuate ends of said fingers have radially outer surfaces that are convex and positioned to lie against the inner surface of the hood, at least when a mating pin contact is inserted into the socket contact and deflects said fingers outwardly.

3. In a method of producing a one-piece hooded socket contact comprising a contact body having a forward mating section and a rear-wire connection section, said mating section comprising a generally cylindrical hood having a front end, and a plurality of spring fingers and lead-in tabs between said fingers, the steps comprising:

providing a sheet meal blank having a front part for forming said forward mating section and a rear part configured to form said wire connection section, said front part having a front edge;

forming said front part with alternately-spaced fingers and tabs extending forwardly from said front edge with the length of said tabs being less than one-quarter of the length of said fingers;

bending said fingers and said tabs upwardly and rearwardly with said fingers extending at an acute angle relative to the remainder of said blank; and rolling said front part of said blank upwardly into a cylindrical configuration to form said hood with said fingers extending inwardly toward the center axis of the hood, including rolling said tabs so their rear ends include at least three locations spaced apart by about 120° and lying on an imaginary circle centered on said axis.

4. A method as set forth in claim 3 wherein:

prior to said bending step, the forward bottom edges of said tabs are coined to provide smooth, curved, inner rear edges on said tabs when said front part is rolled to said cylindrical configuration.

5. A method as set forth in claim 3 wherein:

the forward region of said front part of said blank, including said fingers and said tabs, is coined to a reduced thickness to temper the metal in such region.

6. A one-piece hooded socket contact formed from a sheet metal blank that is rolled to form the contact body comprising:

a contact body having a forward mating section and a rear wire connection section;

said mating section comprising a generally cylindrical hood having a front end, a plurality of spring fingers, and lead-in tabs between said fingers, said fingers and said tabs extending rearwardly from said front end and at least said fingers extending inwardly toward the center axis of said cylindrical hood; and said tabs having a length substantially less than that of said fingers, the length of said tabs being sufficiently short so that said tabs have a circular configuration when said contact body is formed by rolling the sheet metal blank, and said tabs have slits that extend to said rear edges.

7. In a method of producing a one-piece hooded socket contact comprising a contact body having a forward mating section and a rear-wire connection section, said mating section comprising a generally cylindrical hood having a front end, and a plurality of spring fingers and lead-in tabs between said fingers, the steps comprising:

providing a sheet metal blank having a front part for forming said forward mating section and a rear part configured to form said wire connection section, said front part having a front edge;

forming said front part with alternately-spaced fingers and tabs extending forwardly from said front edge with the length of said tabs being less than the length of said fingers;

bending said fingers and said tabs upwardly and rearwardly with said fingers extending at an acute angle relative to the remainder of said blank; and rolling said front part of said blank upwardly into a cylindrical configuration to form said hood with said fingers extending inwardly toward the center axis of the hood, including rolling said tabs so their rear ends include at least three locations spaced apart by about 120° and lying on an imaginary circle centered on said axis;

prior to said rolling step, generally V-shaped slots are formed at the front of said tabs, said slots substantially closing when said front part of said blank is rolled.

8. A one-piece hooded socket contact formed from a sheet metal blank that is rolled to form the contact body, and designed to receive a pin contact, comprising:

a contact body having a forward mating section and a rear wire connection section;

said mating section comprising a generally cylindrical hood having a front end, a plurality of spaced spring fingers extending rearwardly from said front end and inwardly toward the center axis of said cylindrical hood, said fingers terminating in rear ends; and said fingers being separated by open spaces extending from said rear ends of said fingers forwardly for a majority of the length of said fingers, said spaces extending to the inner surface of said hood;

said fingers each having a front portion that extends rearwardly and radially inwardly and a rear portion that extends rearwardly and radially outwardly from the rear end of said front portion, said rear portion having are reversely curved rear end with a convexly curved radially outer surface positioned to press radially inwardly against the inside of said hood when said pin contact is inserted into said socket contact, with portions of said hood lying around said fingers being cylindrical portions of said generally cylindrical hood to allow the rear end of each finger front portion to freely deflect radially outwardly;

said mating section comprises a plurality of tab ends bent about 180° to extend from said hood front end, rearwardly within said hood by less than one-fourth the length of said fingers, with said tabs forming at least three locations circumferentially spaced 120° to center a generally cylindrical pin contact within said hood.

* * * * *